US005647648A

United States Patent [19]

Duesler

[11] Patent Number: 5,647,648

[45] Date of Patent: Jul. 15, 1997

[54] SUPPORT STRUCTURE AND ASSEMBLY METHOD FOR FOOD COURT SYSTEMS

[75] Inventor: Brad J. Duesler, Middleton, Wis.

[73] Assignee: Food Concepts, Inc., Madison, Wis.

[21] Appl. No.: 542,914

[22] Filed: Oct. 13, 1995

[51] Int. Cl.[6] ..... A47B 87/00

[52] U.S. Cl. ..... 312/108; 312/140.1; 312/195; 312/263

[58] Field of Search ..... 312/140.1, 140.3, 312/265.1, 265.3, 265.4, 257.1, 263, 264, 108, 140.2, 195, 198; 52/36.4, 36.5, 36.2, 36.1, 38

[56] References Cited

U.S. PATENT DOCUMENTS

| | | | |
|---|---|---|---|
| 2,992,054 | 7/1961 | Pieschel | 312/140.1 X |
| 3,371,977 | 3/1968 | McCabe | 312/257.1 |
| 4,417,774 | 11/1983 | Bevan et al. | 312/108 |
| 4,433,880 | 2/1984 | Maravelas, Jr. et al. | 312/263 X |
| 4,619,486 | 10/1986 | Hannah et al. | 312/195 |
| 4,656,766 | 4/1987 | Cooper | 52/38 X |
| 4,883,330 | 11/1989 | Armstrong et al. | 312/195 |
| 5,024,167 | 6/1991 | Hayward | 312/195 X |
| 5,176,435 | 1/1993 | Pipkens | 312/204 |
| 5,352,032 | 10/1994 | Cisternino | 312/263 X |

FOREIGN PATENT DOCUMENTS

| | | | |
|---|---|---|---|
| 1048586 | 2/1979 | Canada | 312/198 |
| 1429611 | 5/1969 | Germany | 312/198 |
| 1252881 | 11/1971 | United Kingdom | 312/198 |

OTHER PUBLICATIONS

Food Concepts, Inc., "Modular Food Court System™", Promotional Materials, 1993.

*Primary Examiner*—Peter McCuomo

*Assistant Examiner*—Janet M. Wilkens

*Attorney, Agent, or Firm*—Foley & Lardner

[57] ABSTRACT

A support structure for the simplified assembly of structurally sound food merchandising units and entire food court systems. The support structure includes a horizontal counter support member, front and back vertical support members, and a horizontal bottom shelf support member attached together to form an essentially square or rectangular frame shape. First and second structural support pieces are used to tie the horizontal counter support member and the horizontal bottom shelf support member, respectively, to the vertical support members. Legs, which may be adjustable to allow height adjustment of the support structure, are attached to the bottom of the lower shelf support member. To assemble a food court merchandising unit using the support structure, one support structure is used at each end of the unit. A merchandising unit countertop is attached to the top of the horizontal counter support members of the support structures. A front panel is attached to the front of the front vertical support members of the support structures. Decorative support posts may also be attached to the front and back vertical support members of the support structures. The support posts may be used to support graphics panels and decorative awnings to complete the food court merchandising unit. Variations on the basic food court support structure are used to provide support to end panels at the end of a series of food court merchandising units connected together to form an entire food court, and to support long front panel spans for large merchandising units.

12 Claims, 7 Drawing Sheets

SUPPORT STRUCTURE AND ASSEMBLY METHOD FOR FOOD COURT SYSTEMS

FIELD OF THE INVENTION

This invention pertains generally to food service merchandising systems, and more particularly to food court systems and support structures and assembly methods for such systems.

BACKGROUND OF THE INVENTION

In recent years innovative food service merchandising systems have been developed. Such systems are designed to give consumers convenient access to quality food products, while giving the operator of the system the capability to meet consumer demands with minimal labor, space and capital investment requirements. One such successful food service merchandising system involves the installation of food court systems in convenience stores and other retail environments. An example of such a food court system is the Modular Food Court System™, produced by Food Concepts, Inc., of Madison, Wis. This food court system includes multiple merchandising units connected together to form the food court. Each merchandising unit includes a countertop on which the equipment needed to prepare and/or merchandise food products is placed. Each merchandising unit in the food court may provide different food products for consumer purchase. Thus, for example, the countertops of the several merchandising units may support, for example, popcorn machines, coffee and soft drink dispensers, bakery display cases, and refrigerated or heated display cases for presentation of cold sandwiches, pizza, etc.

In order to maximize the eye appeal of the food court, and of the products provided therein, various aesthetic and structural elements are provided for the individual merchandising units. For example, the countertops may be covered by back lit vinyl, canvas, or other decorative awnings. These awnings are supported by support posts which extend upward from the floor at each corner of the food court merchandising unit. The support posts may also support changeable graphics panels for advertising the food products presented in each merchandising unit. Colorful tile panels, or other ornamentation, are provided on the front of the merchandising unit below the countertop. The awnings, support posts, and tiles are typically color coordinated to maximize the aesthetic appearance of the merchandising unit and of the food court as a whole.

Present food courts are built with traditional cabinet construction which provides the support structure for the merchandising unit. The merchandising unit countertop rests on the top of the cabinet, the support posts are connected at each corner of the cabinet, and the tile or other decorative treatment is applied to the front of the cabinet structure. The basic cabinet structures are made using common cabinet construction techniques which require substantial construction time and expertise. This greatly increases the cost and complexity of assembling the food court system, particularly where cabinet sizes must be customized to accommodate the particular space available for the food court system. Additionally, such cabinet structures are typically made of wood laminate materials which are both expensive and of limited structural integrity. The attachment of decorative front panels and support posts to the basic cabinet structure only increases the time, cost, and complexity of assembling the food court system.

SUMMARY OF THE INVENTION

In accordance with the present invention, a support structure and assembly method for a food court system is provided. The support structure and assembly method allow for simplified on-site assembly of structurally sound food court systems. The support structure of the present invention makes possible the flexible design of food court systems to accommodate available space requirements using support structures which may be manufactured as stock items. The support structure is designed such that the other elements of the food court system are simply attached to it. The support structures are used to form individual food court merchandising units which are connected together, side by side, to form the entire food court system.

The food court support structure of the present invention includes a horizontal counter support member, including counter mounting holes whereby the countertop of a food court system may be attached to the support structure. Vertically oriented front and back support members extend downward from the horizontal counter support member at each end of the counter support member. The front and back support members also preferably have mounting holes, whereby awning and graphic panel support posts may be attached at the front and back of the support structure. The front vertical support member has mounting holes whereby a front panel may be attached to the front of the support structure. A first structural support piece is preferably used to tie the counter support member to the front and back support members to provide additional structural integrity and rigidity to the support structure of the present invention. This first structural support piece preferably also includes holes whereby electric wiring, for example, for providing power to lighted graphic panels or food display cases associated with the food court system, may be supported beneath the counter of the food court merchandising units. A horizontal bottom shelf support member is attached between the front and back vertical support members at the bottom ends of the vertical support members opposite from the counter support member. A second structural support piece is preferably used to tie the horizontal shelf support member to the front and back vertical support members to provide additional structural support and rigidity to the support structure of the present invention. The horizontal counter support member, front and back vertical support members, and shelf support member, combine to form an essentially square or rectangular food court support structure. Legs are attached to the bottom of the horizontal shelf support member, and may also preferably be attached to a side of the second structural support piece. Adjustable feet may be attached to the bottom of the legs to allow adjustment of the height of the support structure of the present invention.

The support structure of the present invention may be used to simply assemble a structurally sound and aesthetically appealing food court system. For example, two support structures in accordance with the present invention may be used to provide support for each side of a single food court merchandising unit. The merchandising unit countertop is secured to the tops of the horizontal counter support members of the support structure. Thereby, the support structure supports the countertop. A decorative front panel may be connected between the front vertical support members of the support structures. Thereby, the front panels are also supported by the support structure of the present invention. Decorative support posts may be attached to the front and back vertical support members of the support structure of the present invention. Thereby, the support structure also supports the vertical support posts. Decorative awnings and graphics panels may, in turn, be attached to the decorative support posts. Additionally, brackets may be attached to the front and back vertical support members to provide support for shelves beneath the food court countertop. Similarly, a shelf may be supported below the food court countertop on the top surface of the bottom shelf support member. Finally, in assembling a complete food court system, conduit support holes provided in the upper vertical support member may be used to support power cables or conduit by threading the cables or conduit through these holes. Thus, the food court support structure of the present invention provides support, either directly or indirectly, for each component of the food court merchandising unit.

Multiple support structures in accordance with the present invention may be employed to assemble multiple merchandising units connected side-by-side to form an entire food court system. In such a system, for example, the lefthand support structure of a first food court merchandising unit would act as the righthand support structure of the food court unit to the left of the first food court merchandising unit. A modified support structure may be used at the ends of the food court system to provide support for decorative end panels. Another modified support structure may be used to provide support for large span front panels. This modified structure has no back vertical support member or horizontal support members, and, as such, is useful in portions of the food court system which are designed to accommodate food preparation and display units which are rolled up behind the merchandising unit.

Further objects, features, and advantages of the invention will be apparent from the following detailed description of the invention taken in conjunction with the accompanying drawings.

BREIF DESCRIPTION OF THE DRAWINGS

Figure 7:
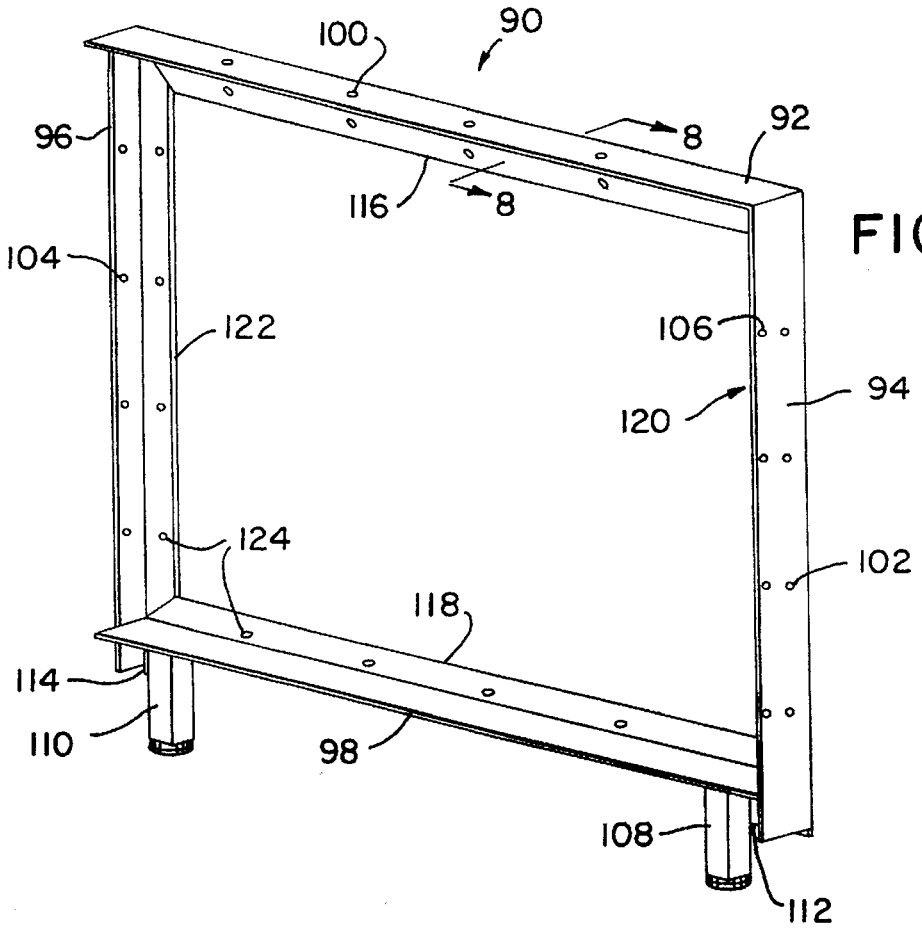

FIG. 7 a perspective view of a modified food court support structure for use as an end support structure for a food court system.

Figure 8:
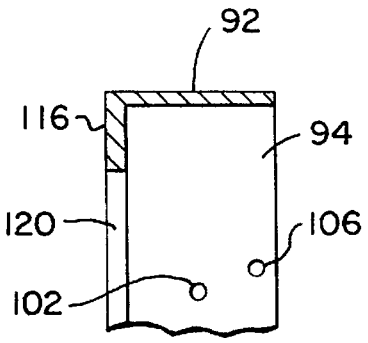

FIG. 8 is a partial cross section of the end support structure shown in FIG. 7 as taken along the line 8—8.

Figure 9:
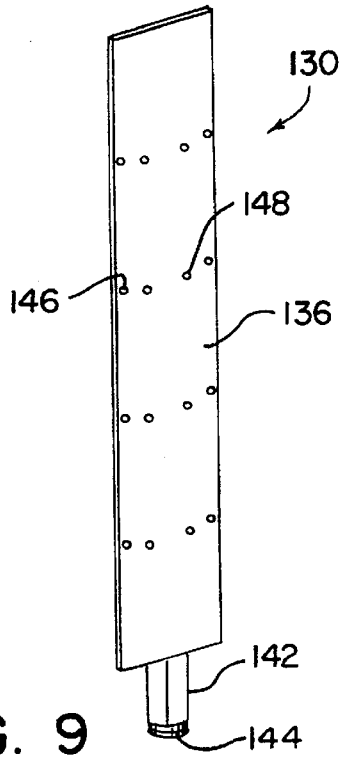

FIG. 9 a perspective view of a modified food court support structure for use as a splicer support structure for supporting large span front panels of a food court system.

Figure 3:
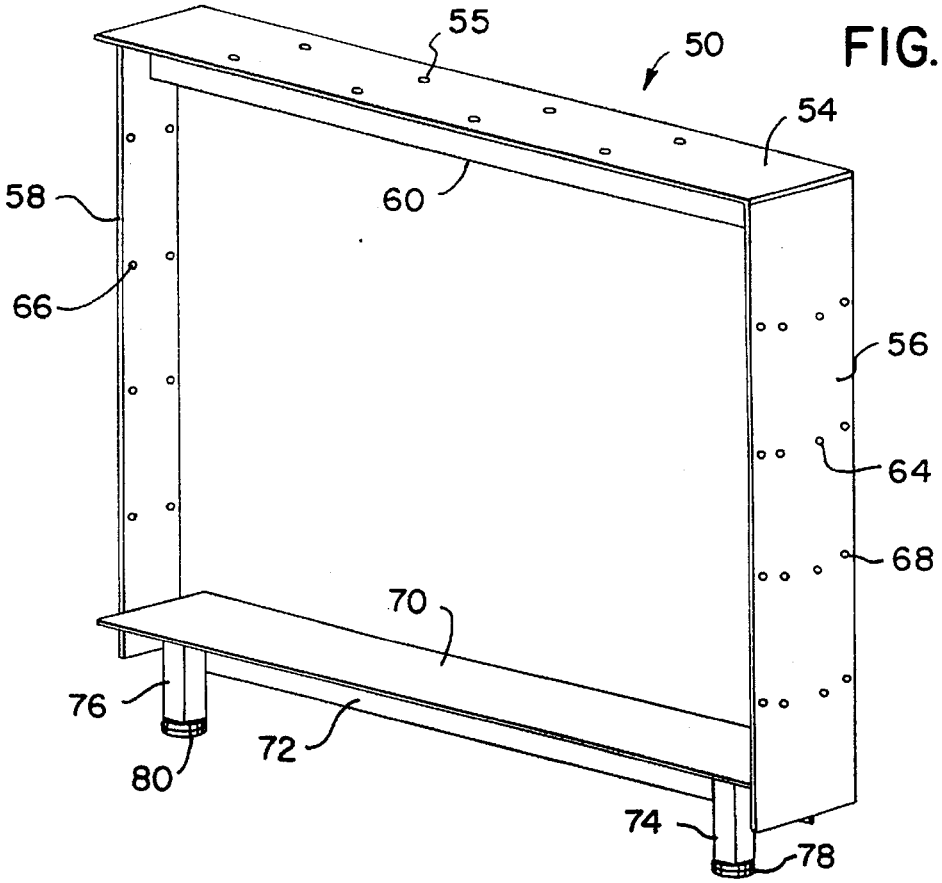
FIG. 3 is a perspective view of a food court support structure in accordance with the present invention.
Figure 4:
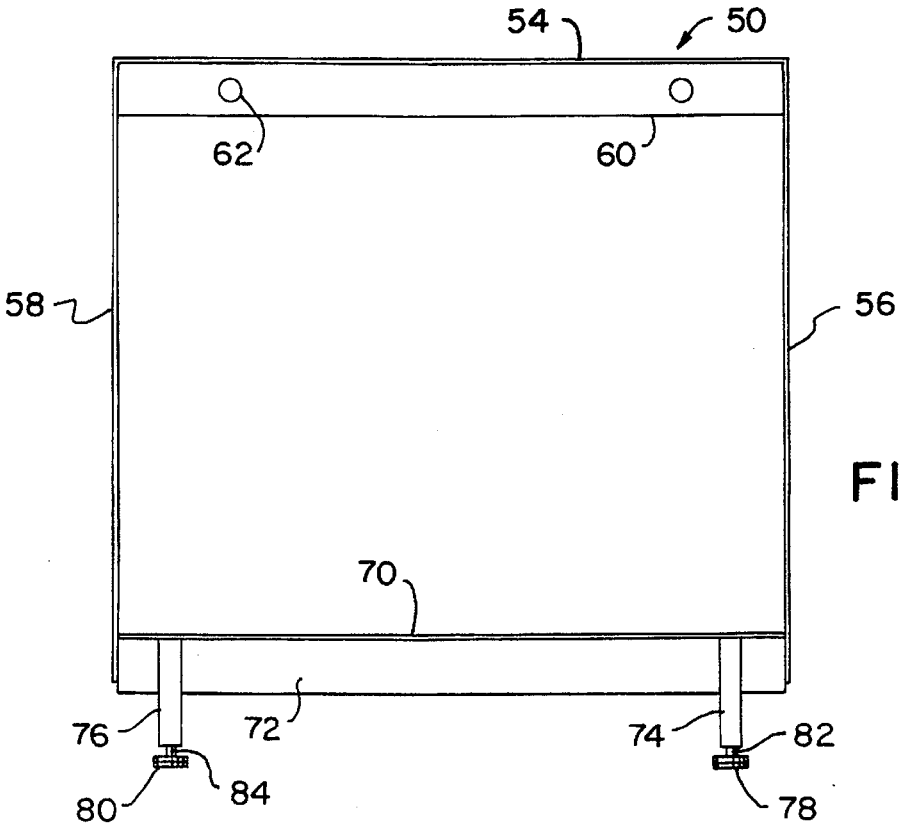
FIG. 4 is a side view of the food court support structure of FIG. 3.
Figure 10:
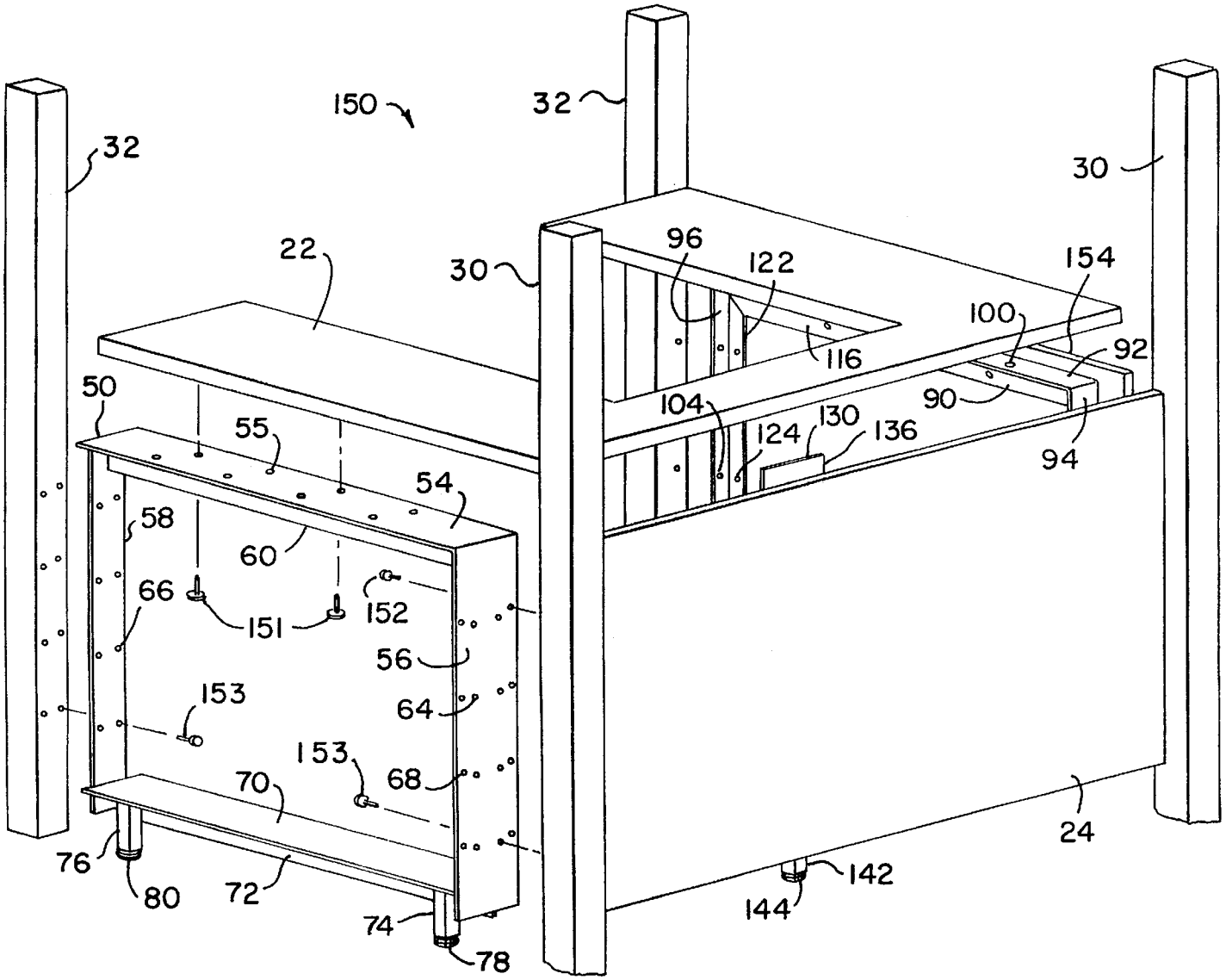

FIG. 10 is an exploded perspective view of the structure of a food court system merchandising unit including the food court support structures of FIGS. 3, 7, and 9.

FIGS. 11–21 are illustrative plan views of various food court system designs which may be implemented using the food court support structure of the present invention.

DETAILED DESCRIPTION OF THE INVENTION

Figure 1:
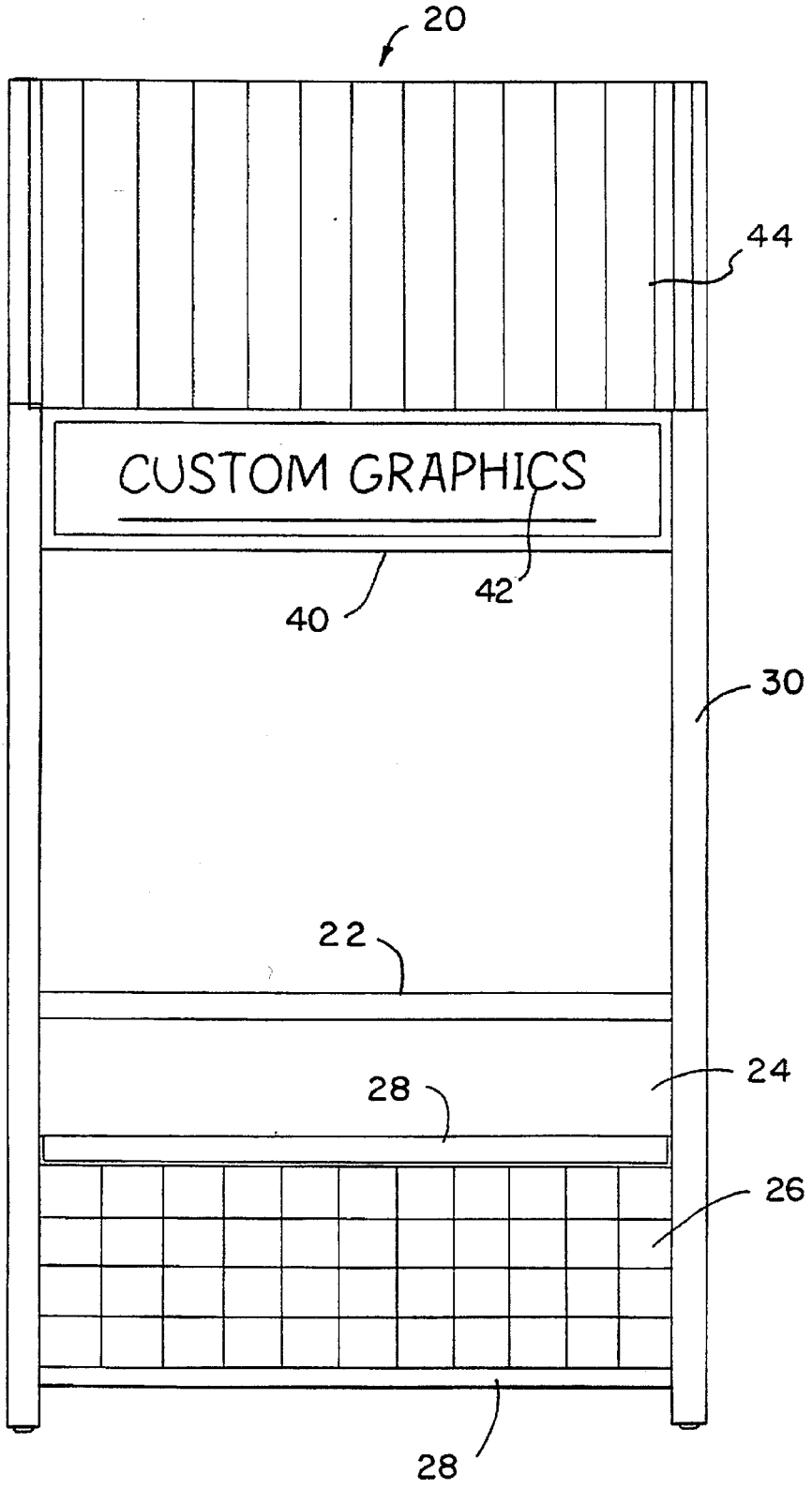
FIG. 1 is a front view of a food court system merchandising unit assembled in accordance with the present invention.
Figure 2:
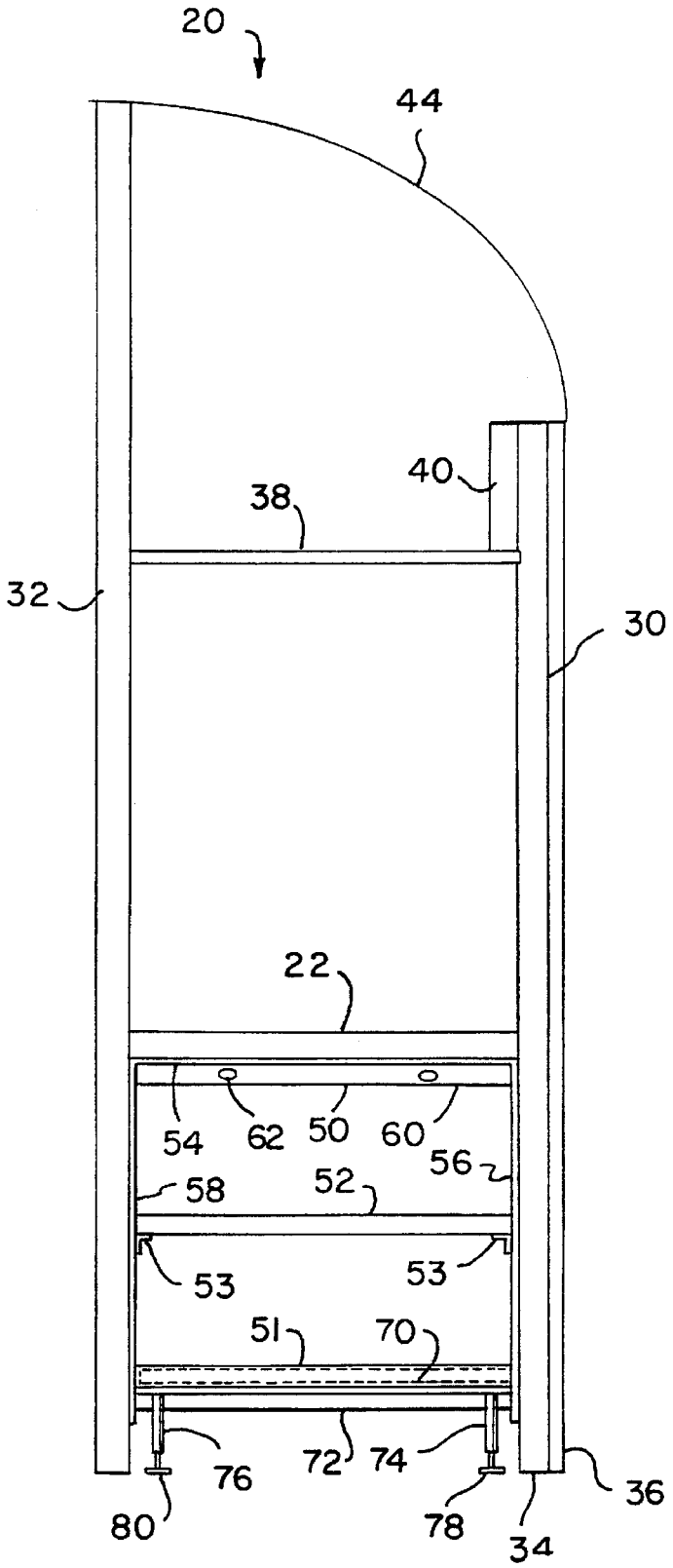
FIG. 2 is a side view of the food court system merchandising unit shown in FIG. 1.

A merchandising unit for a food court system is shown generally at 20 in FIG. 1 and FIG. 2. Typically, several such merchandising units 20 will preferably be connected side-by-side to form an entire food court system. The merchandising unit 20 includes a countertop 22 on which equipment for the preparation and merchandising of food products may be placed. The countertop 22 may preferably be made of standard commercially available countertop material, such as of laminated wood products. A front panel 24 is placed along the front of the unit 20 below the countertop 22. The front panel 24 may preferably be made of a laminated wood product which is decorated, in whole or in part, for example, with a tile pattern 26. The tile pattern 26 may be formed of ceramic tiles applied to the front panel 24, or may be made of a fiberglass sheet product having a simulated tile surface which is painted to simulate actual ceramic tile. The use of such a fiberglass sheet product simplifies the assembly of the unit 20. Rubber or vinyl bumpers 28 may preferably be provided on the front panel 24 along the top and bottom of the tile surface 26 to protect the tile surface 26 from scratches or other damage due to inadvertent contact of shopping carts or other equipment up against the front panel 24 of the merchandising unit 20.

Front and back support posts 30 and 32 may be attached at each corner of the merchandising unit 20. The support posts 30 and 32 extend from approximately floor level to well above the level of the countertop 22. The front and back support posts 30 and 32 are preferably decoratively colored and designed to coordinate with the decoration of the front panel 24. The support posts 30 and 32 may be made of various materials, including wood laminate products, or of metal, such as aluminum. The front support posts 30 may be made of a two-part structure, with a support post structure base 34, and a decoratively shaped support post front piece 36. Alternatively, and preferably, the front support posts 30 may be made as a single extruded aluminum piece which provides the support post structure 34 and decorative shape of the front piece 36 in a single piece 30.

Above the countertop 22 a crossbar 38 is preferably used to connect the front support posts 30 to the back support posts 32 near the top of the support posts 30 and 32. This support piece 38 provides for stability between the front and back support posts 30 and 32. Graphics panels or other forms of signage 40 may be connected between the front support post 30 of the unit 20. The graphics panel 40 preferably includes lettering 42 and/or graphic designs to inform the consumer about the food products offered at the particular unit 20. To improve the eye appeal of the unit 20, and the food court system as a whole, an awning 44 may preferably be assembled which extends from the back support posts 32 to the front support posts 30. The awning 44 may be made of various flexible materials such as vinyl or canvas. The awning 44 and graphics panel 40 may preferably be illuminated for additional effect.

A food court support structure 50 in accordance with the present invention provides the structural support for the merchandising unit 20. The merchandising unit countertop 22 is secured to the top of the support structure 50. The front panel 24 is secured to the front side of the support structure 50. The front support post 30 is also secured to the front of the support structure 50. The back support post 32 is secured to the back of the support structure 50. Thus, the support structure 50 provides structural support, either directly or indirectly, for every component of the unit 20. The support structure 50 may also provide support for a bottom shelf 51 and an adjustable shelf 52 which is connected by brackets 53 to the sides of the support structure 50. The shelves 51 and 52 are accessible from the open back of the unit 20, opposite the front panel 24.

The food court system support structure 50 of the present invention is described in more detail with reference to the various views of FIGS. 3–6 wherein like parts are labelled with the same reference numerals. The support structure 50 is preferably made of a strong structural material, such as 3/16-inch thick hot rolled flat steel. The flat steel pieces of which the support structure 50 is made are preferably welded together. The support structure 50 may also be made of other structural materials connected together in various manners. For example, the support structure 50 might be made of wood or wood-based materials which are screwed or bracketed together. Clearly, however, a steel structure will provide much greater structural support for the food court system than could be provided by wooden materials. The support structure 50 may be manufactured as a stock item which may be used to flexibly implement food courts designed to fit available spaces of various sizes.

The support structure 50 includes a horizontally oriented counter support member 54 which is at least twice as long as it is wide. The counter support member 54 preferably includes counter mounting holes 55 whereby the countertop 22 may be secured to the counter support member 54 by the use of screws or other fasteners. Other methods may also be used to secure the countertop 22 to the counter support member 54. Front and back vertical support members 56 and 58 extend downward from the counter support member 54 at or near the ends of the counter support member 54 and at approximately right angles to the counter support member 54. The vertical support members 56 and 58 are at least twice as tall as they are wide and may preferably be welded to the counter support member 54 where they join. A first structural support piece 60 may preferably be welded to the counter support member 54 and front and back vertical support members 56 and 58 to tie these support members together to form a more rigid and structurally sound support structure 50. This first structural support piece 60 may preferably include one or more conduit support holes 62 which may be used to support electrical wires or other cables or conduit which are required to be run underneath the countertop 22 of the merchandising unit 20. The front and back vertical support members 56 and 58 include front and back support post mounting holes 64 and 66, respectively, whereby the front and back support posts 30 and 32 may be securely mounted to the vertical support members 56 and 58 using screws, bolts, or other fasteners. Other mounting techniques may also be used. The front vertical support member 56 also includes front panel mounting holes 68 whereby the front panel 24 may be mounted on the front vertical support member 56 using screws or other types of fasteners. Other mounting techniques may be used. Note that the back vertical support member 58 is preferably narrower than the front vertical support member 56. The back vertical support member 58 is preferably only as wide as the back support post 32. Thereby, when the back support post 32 is attached to the back vertical support member 58, the support post 32 will completely cover the support member 58. The front vertical support member 56, on the other hand, is wider, to allow connection of both the front support post 30 and the front panel 24 to the front vertical support member 56. Note that when the countertop 22, front and back support posts 30 and 32, and front panel 24 are attached to the support structure 50, the support structure 50 becomes completely covered from the perspective of an outside viewer. This provides a clean and complete appearance for the food court system from the perspective of both food court customers and operators.

The basic food court support structure 50 is completed by a horizontal bottom shelf support member 70 which is at least twice as long as it is wide and which is attached between the front and back vertical support members 56 and 58 near the bottom end of the support members opposite the counter support member 54. The horizontal bottom shelf support member 70 thus joins with the counter support member 54 and vertical support members 56 and 58 to provide the essentially square or rectangular frame shape of the support structure 50. A second structural support piece 72 is connected to the bottom shelf support member 70 and the front and back vertical support members 56 and 58 at right angles to the lower shelf support member 70 and vertical support members 56 and 58. The second support piece 72 is preferably welded to the bottom side of the bottom shelf support member 70 and vertical support members 56 and 58 to tie the support members together to provide additional structural support and stability for the support structure 50.

Figure 5:
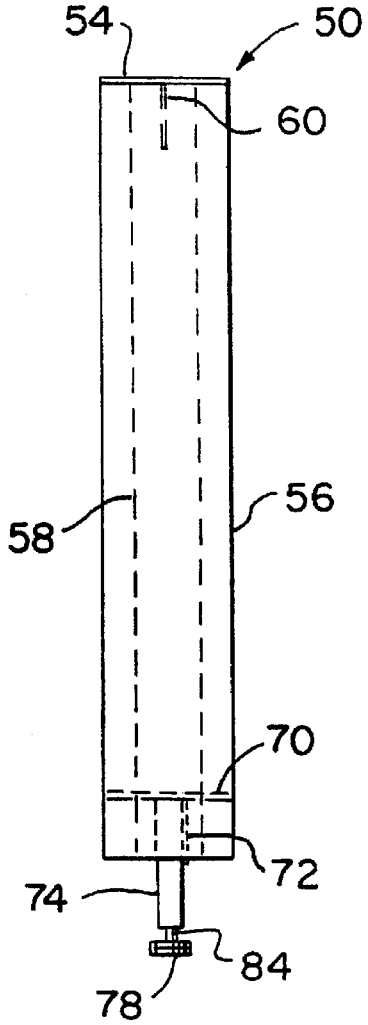
FIG. 5 and FIG. 6 are front and back views, respectively, of the food court support structure of FIG. 3.
Figure 6:
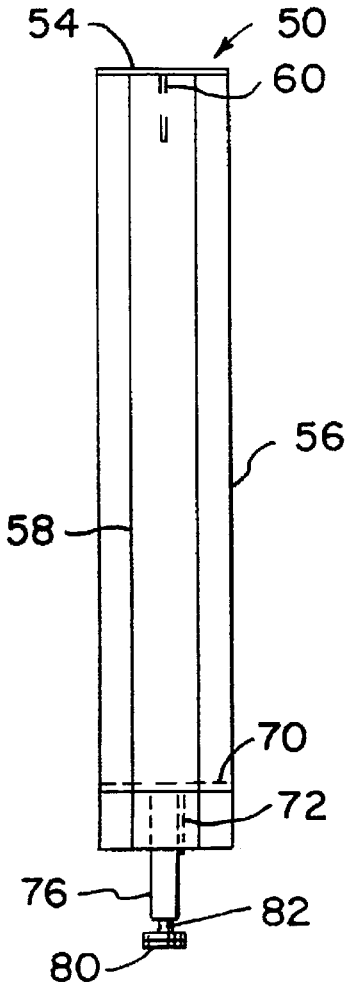

Front and back legs 74 and 76 are attached to the lower shelf support member 70 and, preferably, to the second structural support piece 72. As shown in FIGS. 5 and 6, the legs 74 and 76 are preferably centered along the front and back vertical support members 56 and 58. The legs 74 and 76 are preferably attached to the side of the second structural support piece 72. Therefore, the support piece 72 is preferably attached to the bottom shelf support member 70 in a position slightly displaced from the center of the lower shelf support member 70. The legs 74 and 76 may preferably terminate in caster feet 78 and 80, which are connected to the legs 74 and 76 by threaded bolts 82 and 84 which are secured to the feet 78 and 80 and which ride in a threaded channel in the legs 74 and 76 to allow adjustment of the height of the support structure 50. Of course, various leg and foot designs may be incorporated in the support structure of the present invention. These may include fixed or adjustable leg or foot structures made of painted steel, or stainless steel where required for sanitation purposes.

To assemble a food court merchandising unit 20 using the support structure 50 of the present invention, two support structures 50 are used at each end of the unit 20. The countertop 22 is secured to the counter support members 54 and the front panel 24 is connected to the front vertical support member 56 to connect the support structures 50 together. As described earlier, the front panel 24 may preferably be decorated such as with a tile pattern 26, and may also have holes (not shown) for mounting trash receptacles, cup dispensers, etc. The front and back support posts 30 and 32 are connected to the front and back vertical support members 56 and 58 of the support structure 50 at each corner of the merchandising unit 20. The support post cross piece 38, graphics panel 40, and awning 44 may then be connected to the support posts 30 and 32 to complete the basic merchandising unit structure. Additionally, a bottom shelf 51 may be placed on top of the bottom shelf support member 70, and intermediate shelf support brackets 53 may be attached to the vertical support members 56 and 58 to provide support for one or more intermediate shelves 52. The brackets 53 may be mounted, for example, in additional mounting holes (not shown) in the vertical support members 56 and 58. Generally, when the front panel 24 is in place, the shelves 52 and 54 will be accessible only from the back side of the merchandising unit 20. However, many modifications of the basic merchandising unit design described herein may be made in accordance with the present invention. For example, the bottom shelf 51 may be used to support a slide-out drawer or shelf (not shown) which may be accessed through an opening in the front panel 24 of the merchandising unit 20.

To assemble an entire food court system, several merchandising units assembled in accordance with the present invention and employing the support structure 50 are assembled side-by-side. In such a food court system, for example, the lefthand support structure 50 of a first merchandising unit 20 will act as the righthand support structure 50 for the adjacent merchandising unit to the left of the first merchandising unit 20. Therefore, the independent merchandising units are joined together at their support structures 50. The countertops 22 and awnings 44 may be run along the entire food court system or selected portions of the food court system so as to cover and link together multiple adjacent units 20.

A modification of the basic food court system support structure 50 of the present invention may be utilized for the last support structure at the end of a series of connected merchandising units 20 which form an entire food court system. This modified end support structure, shown at 90 in FIG. 7, allows a side panel, which may be decorated similarly to the merchandising unit front panel 24, to be mounted at the side end of the food court system. The end support structure 90 is basically the center support structure 50 divided in half. The end support structure 90 includes a counter support member 92, front and back vertical support members 94 and 96, and a bottom shelf support member 98. The support members 92, 94, 96, and 98 perform the same functions as the support members 54, 56, 58 and 70, respectively, of the center support structure 50. The counter support member 92 includes counter mounting holes 100 whereby the food court countertop 22 is mounted to the end support structure 90. The front and back vertical support members 94 and 96 include front and rear support post mounting holes 102 and 104, whereby the front and back support post 30 and 32 may be mounted to the support structure 90. Note that the back vertical support member 96 is preferably the same width as the rear support post 32 which is to be attached to it so that, when the back support post 32 is attached to the back vertical support member 96, the vertical support member 96 is not visible to a food court customer or operator standing behind the food court system. On the other hand, the front vertical support member 94 is wider than the rear vertical support member 96 to accommodate front panel mounting holes 106 whereby the front panel unit 24 of a food court merchandising unit 20 may be mounted to the end support structure 90. Front and back legs 108 and 110 are attached to the bottom of the lower shelf support member 98. The legs 108 and 110 are preferably of the same design as the legs 74 and 76 of the center structure 50. Thus, as for the basic support structure 50, various designs may be used to implement the legs 108 and 110. Support pieces 112 and 114 may be used to provide additional support for the legs 108 and 110.

The main difference between the end support structure 90 and the center support structure 50 lies in the placement of the first and second structural support pieces 116 and 118. Rather than running near the center of the counter support member 92 and bottom shelf support member 98, the structural support pieces 116 and 118 are attached at the edge of the counter support member 92 and bottom shelf support member 98, respectively. This is shown in more detail for the first structural support piece 116 in FIG. 8. Moreover, the second structural support piece 118 is mounted along the top, rather than the bottom side, of the bottom shelf support member 98. Additionally, third and fourth structural support pieces 120 and 122 are connected along the edges of the front and back vertical support members 94 and 96, respectively. (Note that the third structural support piece 120 is obscured from view in FIG. 7 by the front vertical support member 94.) The structural support pieces 116, 118, 120, and 122, therefore form a frame around an edge of the end support structure 90. End panel mounting holes 124 are provided in the structural support pieces 116, 118, 120 and 122, whereby a decorative end panel (not shown in FIG. 7) may be mounted to the end support structure 90.

Note that the end support structure 90 shown is for the far righthand end of a food court system. For a lefthand end support structure, the structural support pieces 116, 118, 120 and 122 would be moved to the other side of the support members 92, 94, 96, and 98, respectively, and the relative positions of the support post and front panel mounting holes 102 and 106 on the front vertical support member 96 would be reversed. Note also that the end support structure 90 may be easily made using four angle irons welded together. Each angle iron would form one support piece/support member pair.

Another modified form of the center support structure 50 of the present invention is the splicer piece support structure 130 shown in FIG. 9. The splicer piece structure 130 may be used in the center of a merchandising unit 20 to support a large span front panel 24. The splicer support structure 130 includes a front vertical support member 136. The vertical support member 136 includes front panel mounting holes 146 whereby the front panel 24 of a food court merchandising unit 20 may be secured to the splicer support 130. The vertical support member 136 may also include support post mounting holes 148 whereby a front support post 30 may be mounted to the splicer support structure 130. A leg 142 having a foot 144 is attached to the bottom of the vertical support member 136. The leg 142 and foot 144 may be of various designs and may preferably be of the same design used for the center support structure 50.

The use of the center support structure 50, end support structure 90, and splicer support structure 130 of the present invention to assemble a merchandising unit 150 for a food court system is described with reference to FIG. 10. When fully assembled, the merchandising unit 150 would stand as the righthand end unit of a series of such units connected together to form an entire food court system. Thus, other merchandising units would preferably be connected to the unit 150 to the right of the unit 150. The center support structure 50 of the merchandising unit 150, which forms the left side of the unit 150, would act as the righthand side support for a unit attached adjacent and to the left of unit 150.

The center support structure 50 and end support structure 90 form the lefthand and righthand support structures for the merchandising unit 150. The support structures 50 and 90 are separated by a distance which defines the size of the merchandising unit 150. The unit countertop 22 is attached to the horizontal counter support members 54 and 92 of the center support structure 50 and end support structure 90, respectively, e.g., using screws 151 or other fasteners through mounting holes 55 and 100. Similarly, a front panel 24 is attached to the front vertical support members 56 and 94 of the center support structure 50 and end support structure 90, respectively, e.g., using screws 152 or other fasteners through mounting holes 68 and 106. Thus, the support structures 50 and 90 are tied together by the countertop 22 and front panel 24. Front and back decorative support posts 30 and 32 are attached to the front vertical support members 56 and 94 and back vertical support members 58 and 96 of the center support structure 50 and end support structure 90, respectively, e.g., using screws, bolts, or other fasteners 153 through mounting holes 64, 66, 102 and 104. (Note that only a few of the fasteners 151, 152, and 153 required are illustratively show in FIG. 10.) As shown in FIGS. 1 and 2, the support posts 30 and 32 may be used to support a graphics panel 40 and decorative awning 44 (these features are not shown in FIG. 10). To complete the basic merchandising unit structure, an end panel 154 which may be decorated similarly to the front panel 24 is attached to the side of the end support member 90. The end panel 154 is mounted on the first support piece 116, second support piece 118, third support piece 120, and fourth support piece 122 of the end support structure 90 using screws or other fasteners (not shown) through mounting holes 124.

Since the merchandising unit 150 has a relatively large front panel span, a splicer support structure 130 is preferably used to support the front panel 24 near the center of its span. The front panel 24 is, therefore, attached to the vertical support member 136 of the splicer support structure 130, e.g., using screws or other fasteners (not shown) through mounting holes 146. The resulting merchandising unit 150 is both structurally sound and is sufficiently flexible to allow various modifications. For example, as shown in FIG. 10, the unit countertop 22 may be cut to accommodate a food preparation unit which may be rolled into position from behind the merchandising unit 150. The splicer support piece 130 allows the front panel 24 to be supported without interfering in the positioning of such a food preparation unit.

Note that the components of the food court merchandising unit 20, including the support structure 50, food court counter top 22 and front panel 24, may conveniently be provided as an unassembled kit. The pieces of the kit may be easily assembled into a food court at a convenience store or other retail location.

Figure 11:
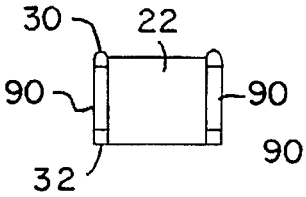
Figure 12:
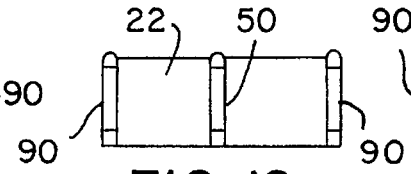
Figure 13:
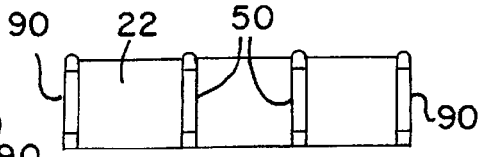
Figure 14:
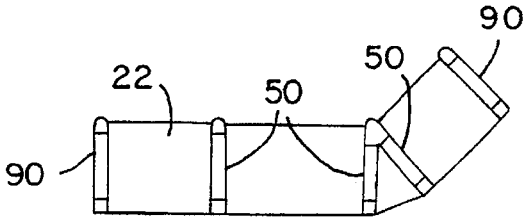
Figure 15:
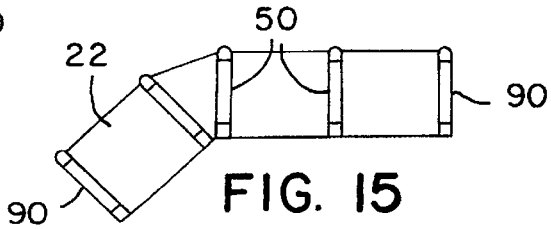
Figure 16:
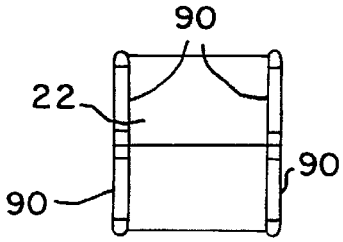
Figure 17:
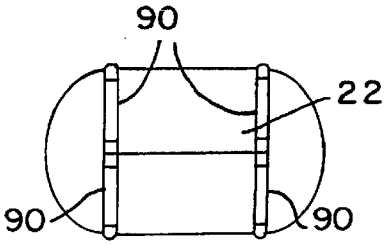
Figure 18:
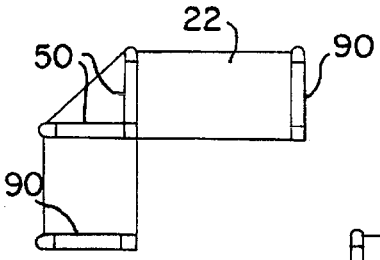
Figure 19:
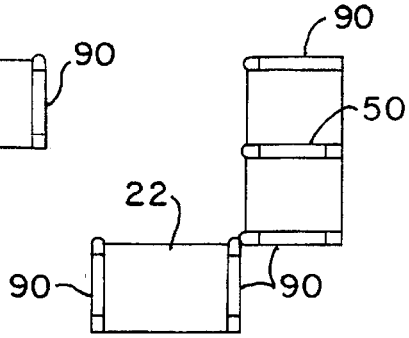
Figure 20:
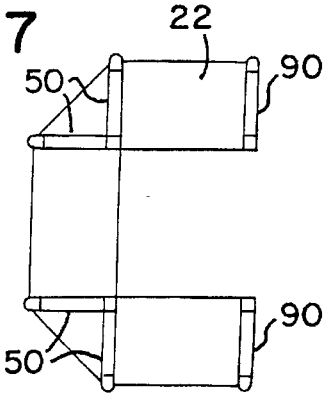
Figure 21:
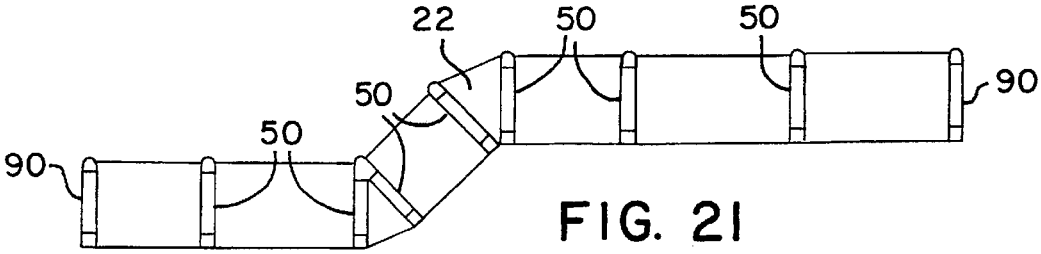

The flexibility of the food court support structure of the present invention to provide support for food court systems adopted to fit any floor plan is illustrated by the various food court designs shown in FIGS. 11–21. Note that these figures are illustrative only, showing only the support structures 50 and 90, counter top 22, and front and back support posts 30 and 32 components of a food court system. Note also that, in actual use, the countertops 22 of the food court would cover the support structures 50 and 90. A single food court merchandising unit using two end support structures 90 is shown in FIG. 11. This basic structure is easily expanded to two, three, or more adjacent units as shown in FIGS. 12 and 13. Note that a single countertop 22 may be used to span multiple units. Center support structures 50 may be placed at angles to each other to form, with angled counter pieces and specially adopted front posts 30, angled food court designs as illustrated in FIGS. 14 and 15. Support structures may be placed back-to-back to form food court island structures as shown in FIGS. 16 and 17 (with curved end caps). The support structure of the present invention may be used for food court designs forming inside or outside 90° angles, horseshoe shapes, or very long food courts with multiple angled sections as illustrated in FIGS. 18–21, respectively. It is clear that the support structure of the present invention, which may be produced as a stock item, may be used to implement an infinite number of food court layouts.

It is understood that this invention is not confined to the particular embodiments herein illustrated and described, but embraces all such modified forms thereof as come within the scope of the following claims.

What is claimed is:

1. A food court system, comprising:

(a) a plurality of spaced apart food court support structures, each support structure including a horizontal counter support member having a top surface, a bottom surface, a front end, and a back end, a front vertical support member having a top end, a bottom end, a front face, and a back face, and which is attached at its top end to the counter support member, a back vertical support member having a top end, a bottom end, a front face, and a back face, and which is attached at its top end to the counter support member, a horizontal bottom shelf support member having a top surface, a bottom surface, a front end, and a back end, and which is attached at its front end to the front vertical support member and at its back end to the back vertical support member to form, with the horizontal counter support member and the front and back vertical support members, a frame structure which is at least twice as high and long as it is wide, and at least one leg attached to and extending from the bottom surface of the bottom shelf support member;

(b) at least one food court counter top secured to the top surface of the horizontal counter support member of each support structure to thereby join the support structures together;

(c) a food court front panel secured to the front face of the front vertical support member of each support structure such that a front panel extends between the front faces of the spaced apart support structures and is supported thereby;

(d) a front support post secured to the front face of the front vertical support member of each support structure, supported thereby, and extending in a vertical direction beyond the counter top;

(e) a back support post secured to the back face of the back vertical support member of each support structure, supported thereby, and extending in a vertical direction beyond the counter top;

(f) a decorative awning attached between the front and back vertical support posts and thereby positioned over the counter top; and (g) at least one graphics panel secured between two of the front support posts.

2. The food court system of claim 1 wherein the horizontal counter support member, the front vertical support member, the back vertical support member, and the horizontal lower shelf support member of each support structure are made from steel sheet pieces which are welded together.

3. The food court system of claim 1 including additionally a first structural support piece mounted to tie the horizontal counter support member, the front vertical support member, and the back vertical support member of each support structure together; and a second structural support piece mounted to tie the horizontal bottom shelf support member, the front vertical support member, and the back vertical support member of each support together.

4. The food court system of claim 1 including additionally a lower shelf placed on the top surface of the horizontal lower shelf support member of each support structure.

5. The food court system of claim 1 wherein there are at least three food court support structures joined together by said at least one counter top and wherein the length of the counter top between a first pair of the support structures is different from the length of the counter top between a second pair of the support structures.

6. The food court system of claim 1 wherein there are at least three food court support structures joined together by said at least one counter top and wherein at least two of the food court support structures are placed at an angle with respect to each other such that the counter top joining the two angled support structures together is approximately triangular in shape.

7. The food court system of claim 1 wherein the counter top is cut to accommodate a food preparation unit.

8. The food court system of claim 1 wherein the food court front panel includes a fiberglass sheet product having a simulated tile surface.

9. The food court system of claim 1 wherein the food court front panel includes bumpers extending from a front surface thereof.

10. A method for assembling a food court system, comprising the steps of:

(a) providing a plurality of food court support structures, each support structure including a horizontal counter support member having a top surface, a bottom surface, a front end, and a back end, a front vertical support member having a top end, a bottom end, a front face, and a back face, and which is attached at its top end to the counter support member, a back vertical support member having a top end, a bottom end, a front face, and a back face, and which is attached at its top end to the counter support member, a horizontal bottom shelf support member having a top surface, a bottom surface, a front end, a back end, and which is attached at its front end to the front vertical support member and at its back end to the back vertical support member to form, with the horizontal counter support member and the front and back vertical support members a frame structure which is at least twice as high and long as it is wide, and at least one leg attached to and extending from the bottom surface of the bottom shelf support member;

(b) securing at least one food court counter top to the top surface of the horizontal counter support member of each support structure to thereby join the support structures together such that the support structures are spaced apart from each other;

(c) securing a food court front panel to the front face of the front vertical support member of each support structure such that a front panel extends between the front faces of the spaced apart support structures and is supported thereby;

(d) securing a front support post to the front face of the front vertical support member of each support structure, such that the front support post is supported by the support structure and extends in a vertical direction beyond the counter top;

(e) securing a back support post to the back face of the back vertical support member of each support structure, such that the back support post is supported by the support structure and extends in a vertical direction beyond the counter top;

(f) attaching a decorative awning between the front and back support posts such that the awning is positioned over the counter top; and (g) securing at least one graphics panel between two of the front support posts.

11. The method of claim 10 comprising additionally the step of placing a bottom shelf on the top surface of the horizontal bottom shelf support member of each support structure.

12. A food court system assembly kit, comprising (a) a plurality of food court support structures, each support structure including a horizontal counter support member having a top surface, a bottom surface, a front end, and a back end, and mounting holes in the top surface through which fasteners may be passed for mounting a food court counter top to the top surface, a front vertical support member having a top end, a bottom end, a front face, and a back face, and which is attached at its top end to the counter support member, and having mounting holes in its front face through which fasteners may be passed for mounting a food court front panel and a front support post to the front face, a back vertical support member having a top end, a bottom end, a front face, and a back face, and which is attached at its top end to the counter support member, and having mounting holes in its back face through which fasteners may be passed for mounting a back support post to the back face, a horizontal bottom shelf support member having a top surface, a bottom surface, a front end, and a back end, and which is attached at its front end to the front vertical support member and at its back end to the back vertical support member to form, with the horizontal counter support member and the front and back vertical support members, a frame structure which is at least twice as high and long as it is wide for supporting a food court counter top, front panel, and front and back support posts, and at least one leg attached to and extending from the bottom surface of the bottom shelf support member whereby the food court system may be supported on a floor;

(b) at least one food court counter top to be secured to the top surfaces of the horizontal counter support members of the support structures to thereby join the support structures together such that the support structures are spaced apart from each other;

(c) at least one food court front panel to be secured to the front faces of the front vertical support members of the support structures such that a front panel extends between the front faces of the spaced apart support structures and is supported thereby;

(d) plurality of front support posts, each front support post to be secured to the front face of the front vertical support member of a support structure, such that the front support posts are supported by the support structures and extend in a vertical direction beyond the counter top;

(e) a plurality of back support posts, each back support post to be secured to the back face of the back vertical support member of a support structure, such that the back support posts are supported by the support structures and extend in a vertical direction beyond the counter top;

(f) a decorative awning to be attached between the front and back support posts such that the awning is positioned over the counter top; and (g) at least one graphics panel to be secured between two of the front support posts.

* * * * *